US008326700B1

(12) United States Patent
Laufer et al.

(10) Patent No.: US 8,326,700 B1
(45) Date of Patent: Dec. 4, 2012

(54) SYSTEM, METHOD, AND COMPUTER PROGRAM FOR AUTOMATICALLY DISPLAYING INFORMATION FOR QUICKLY COMPARING A SPECIFIC ITEM WITH OTHERS

(75) Inventors: Avner Laufer, Petach Tikva (IL); Dov Rosner, Kfar Yona (IL)

(73) Assignee: Amdocs Software Systems Limited, Dublin (IE)

( * ) Notice: Subject to any disclaimer, the term of this patent is extended or adjusted under 35 U.S.C. 154(b) by 585 days.

(21) Appl. No.: 12/365,075

(22) Filed: Feb. 3, 2009

(51) Int. Cl.
*G06Q 30/00* (2006.01)

(52) U.S. Cl. ..... 705/26.64; 705/26.1; 705/26.61; 705/26.62; 705/27.1

(58) Field of Classification Search ..... 705/26, 705/27, 26.1, 26.61, 26.62, 26.64, 27.1
See application file for complete search history.

(56) References Cited

U.S. PATENT DOCUMENTS

| | | | | |
|---|---|---|---|---|
| 6,167,383 | A * | 12/2000 | Henson | 705/26.5 |
| 7,127,414 | B1 * | 10/2006 | Awadallah et al. | 705/26.8 |
| 2006/0167757 | A1 * | 7/2006 | Holden et al. | 705/26 |
| 2006/0195428 | A1 * | 8/2006 | Peckover | 707/3 |
| 2006/0212362 | A1 * | 9/2006 | Donsbach et al. | 705/26 |
| 2007/0073591 | A1 * | 3/2007 | Perry et al. | 705/26 |
| 2007/0192298 | A1 | 8/2007 | Michalke et al. | 707/3 |
| 2008/0091546 | A1 * | 4/2008 | Kirovski et al. | 705/26 |
| 2008/0140577 | A1 * | 6/2008 | Rahman et al. | 705/71 |
| 2008/0140581 | A1 | 6/2008 | Mayer | 705/80 |

OTHER PUBLICATIONS

"York University builds a Linux cluster to speed up searching unstructured data", by Cliff Saran, Computer Weekly, Jul. 15, 2003, p. 22.*

* cited by examiner

*Primary Examiner* — Jeffrey A Smith
*Assistant Examiner* — Anne Georgalas
(74) *Attorney, Agent, or Firm* — Zilka-Kotab, PC

(57) ABSTRACT

A system, method, and computer program product are provided for automatically displaying information comparing items. In use, a first item is received for displaying information associated the first item. Furthermore, information comparing the first item and a second item is automatically displayed in response to the receipt of the first item, the second item sharing at least one aspect with the first item.

20 Claims, 5 Drawing Sheets

SYSTEM, METHOD, AND COMPUTER PROGRAM FOR AUTOMATICALLY DISPLAYING INFORMATION FOR QUICKLY COMPARING A SPECIFIC ITEM WITH OTHERS

FIELD OF THE INVENTION

The present invention relates to displaying item information, and more particularly to displaying information comparing items.

BACKGROUND

Traditionally, information associated with items have displayed to users browsing the items, purchasing the items, etc. Oftentimes, item information is displayed upon a user selecting to view an item on a webpage, searching for an item via a webpage (e.g. of a search engine, retail website, etc.). Unfortunately, many drawbacks exist for providing comparisons of information associated with one item with information associated with another item.

For example, a user may be overloaded with the amount of information provided in a full comparison of different items. Additionally, by way of example, a user is conventionally required to select both items to be compared (e.g. via checkboxes next to each of each such items) and to further select a command (e.g. comparison button, etc.) for the selected items to be compared. The information associated with the items is then retrieved and compared upon the selection thereof, such that the comparison may be provided to the users. Thus, providing comparisons of items has conventionally be inefficient, for example, by requiring multiple manual selections by the user, by reducing system performance due to multiple interfaces being opened to receive the multiple manual selections, by requiring processing to be performed on the selected items in order to generate the comparison (e.g. resulting in consumption of time, resources, etc.), etc.

There is thus a need for addressing these and/or other issues associated with the prior art.

SUMMARY

A system, method, and computer program product are provided for automatically displaying information comparing items. In use, a first item is received for displaying information associated the first item. Furthermore, information comparing the first item and a second item is automatically displayed in response to the receipt of the first item, the second item sharing at least one aspect with the first item.

DETAILED DESCRIPTION

Figure 1:
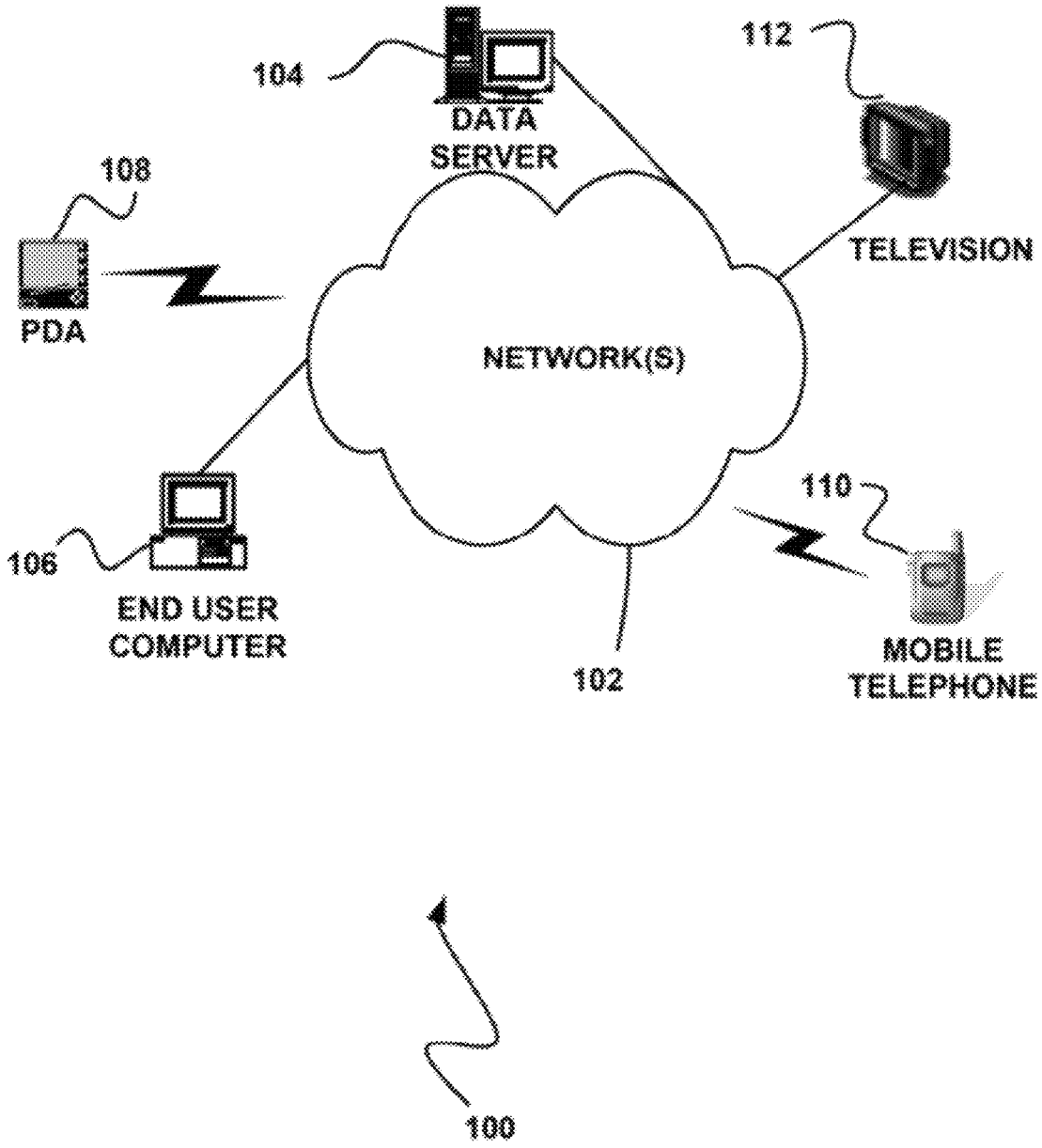
FIG. 1 illustrates a network architecture, in accordance with one possible embodiment.

FIG. 1 illustrates a network architecture 100, in accordance with one possible embodiment. As shown, at least one network 102 is provided. In the context of the present network architecture 100, the network 102 may take any form including, but not limited to a telecommunications network, a local area network (LAN), a wireless network, a wide area network (WAN) such as the Internet, peer-to-peer network, cable network, etc. While only one network is shown, it should be understood that two or more similar or different networks 102 may be provided.

Coupled to the network 102 is a plurality of devices. For example, a server computer 104 and an end user computer 106 may be coupled to the network 102 for communication purposes. Such end user computer 106 may include a desktop computer, lap-top computer, and/or any other type of logic. Still yet, various other devices may be coupled to the network 102 including a personal digital assistant (PDA) device 108, a mobile phone device 110, a television 112, etc.

Figure 2:
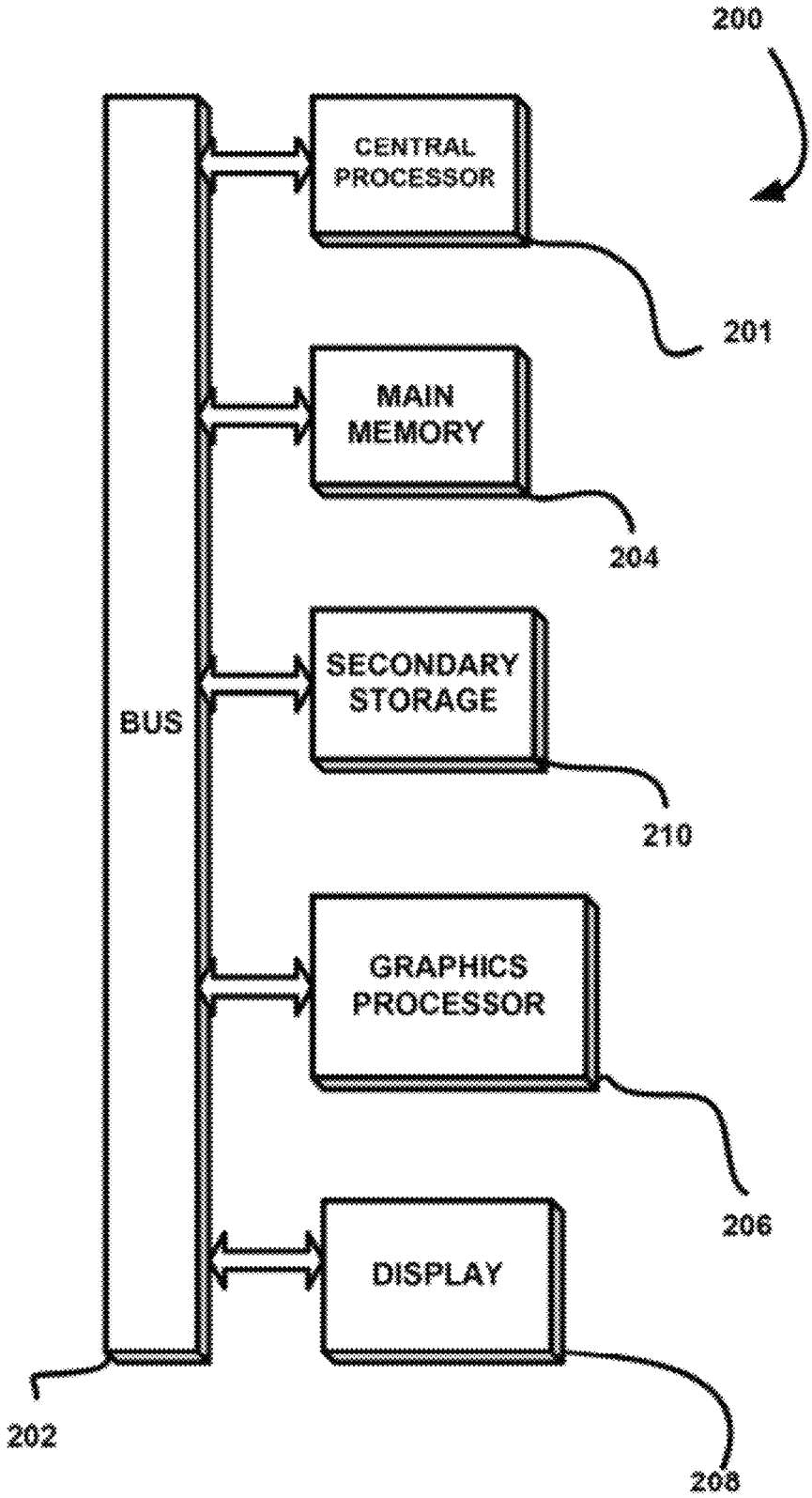
FIG. 2 illustrates an exemplary system, in accordance with one embodiment.

FIG. 2 illustrates an exemplary system 200, in accordance with one embodiment. As an option, the system 200 may be implemented in the context of any of the devices of the network architecture 100 of FIG. 1. Of course, the system 200 may be implemented in any desired environment.

As shown, a system 200 is provided including at least one central processor 201 which is connected to a communication bus 202. The system 200 also includes main memory 204 [e.g. random access memory (RAM), etc.]. The system 200 also includes a graphics processor 206 and a display 208.

The system 200 may also include a secondary storage 210. The secondary storage 210 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 204 and/or the secondary storage 210. Such computer programs, when executed, enable the system 200 to perform various functions (to be set forth below, for example). Memory 204, storage 210 and/or any other storage are possible examples of computer-readable media.

Figure 3:
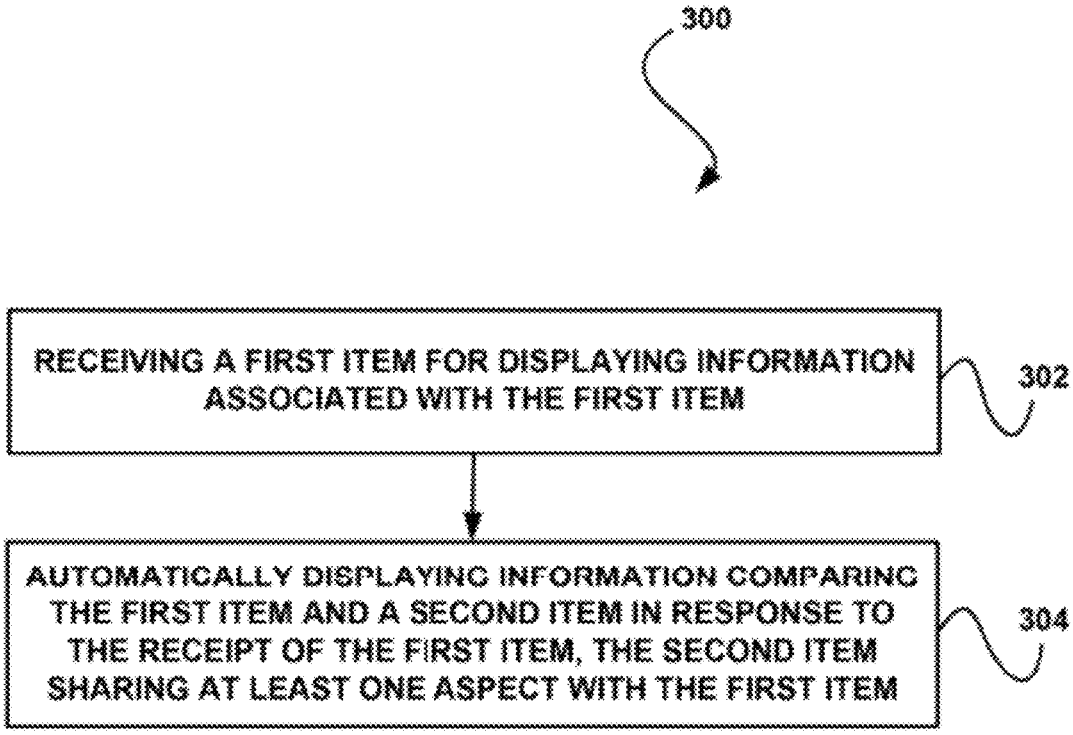
FIG. 3 illustrates a method for automatically displaying information comparing items, in accordance with one embodiment.

FIG. 3 illustrates a method 300 for automatically displaying information comparing items, in accordance with one embodiment. As an option, the method 300 may be carried out in the context of the details of FIGS. 1 and/or 2. Of course, however, the method 300 may be carried out in any desired environment. Further, the aforementioned definitions may equally apply to the description below.

As shown in operation 302, a first item is received for displaying information associated with the first item. With respect to the present description, the first item may include any good and/or service (e.g. a digital representation thereof) capable of being selected for display of information associated therewith. Just by way of example, the first item may include a mobile device (e.g. telephone, PDA, etc.), a telecommunications service, etc.

To this end, the information associated with the first item may include any type of information that is associated with the first item in any manner. In one embodiment, the information associated with the first item may include a description (e.g. text) of the first item. In another embodiment, the information associated with the first item may include a price of the first item.

In yet another embodiment, the information associated with the first item may include an image of the first item (e.g.

a picture of a product, etc.). In still yet another embodiment, the information associated with the first item may include a link to supplemental information associated with the first item. For example, the supplemental information may include information not already displayed in association with the first item, such as a further description of the first item, etc.

Additionally, the first item may be received in any desired manner. In one embodiment, the first item may be received by receiving an identifier of the first item. For example, an identifier that is unique to a product and/or service may be received.

In another embodiment, the first item may be received as a result of user input. For example, the first item may be received in response to a user selection of the first item [e.g. via a graphical user interface (GUI)]. As another example, the first item may be received in response to a query (e.g. search) for the first item performed by the user (e.g. by inputting at least one keyword associated with the first item, etc.).

As noted above, the first item is received for displaying the information associated therewith. For example, the first item may be selected, queried, etc. such that the information associated therewith may be displayed as a result. Optionally, the first item may be received via a first interface (e.g. GUI, webpage, etc.) and the information associated with the first item may be displayed via the first interface and/or any other interface. In various exemplary embodiments, the interface(s) via which the first item is received and/or the information associated with the first item is displayed may be associated with a retailer of the first item (e.g. a retailer website), a search engine (e.g. a search engine website), etc.

Furthermore, information comparing the first item and a second item is automatically displayed in response to the receipt of the first item, where the second item shares at least one aspect with the first item. Note operation 304. With respect to the present description, the second item may also include any good and/or service (e.g. a digital representation thereof) sharing at least one aspect with the first item. Thus, the second item may be similar to the first item by virtue of the aspect shared between the first item and the second item. It should be noted that while only a single second item is described herein, information comparing any desired number of additional items each sharing any aspect with the first item may be automatically displayed.

It should also be noted that the second item may be selected in any desired manner for displaying information comparing the first item and such second item. For example, the second item may be selected from a database of items (e.g. goods and/or services). As another example, the second item may be selected based on a determination that the second item shares the most aspects with the first item than any other second item capable of being selected.

As yet another example, the second item may be selected based on a determination that the second item shares a predetermined aspect (e.g. default aspect) with the first item. As another example, the second item may be predetermined with respect to the first item, for displaying the comparison information thereof when the first item is received.

Of course, the aspect shared by the first item and the second item may also optionally be updateable by a user, such that the second item may be selected based on an aspect input by the user. To this end, the second item may change based on the aspect input by the user. In this way, the second item may optionally be selected based on a determination that the second item shares the user selected aspect with the first item, and accordingly the information comparing the first item and the second item may be automatically updated in response to second aspect changing (i.e. the user updating the aspect shared by the second item and the first item.

In one embodiment, the aspect shared by the first item and the second item may include a category. Thus, the first item and the second item may be capable of being categorized under a single category (e.g. of goods and/or services). For example, the first item and the second item may include a same type of product (e.g. mobile telephone) and/or service.

In another embodiment, the aspect shared by the first item and the second item may include a manufacturer. Accordingly, the first item and the second item may optionally both be manufactured by a single manufacturer. Of course, as another option, the aspect shared by the first item and the second item may include a provider (e.g. retailer) thereof.

In yet another embodiment, the aspect shared by the first item and the second item may include a color. It should be noted that the aspect shared by the first item and the second item may include any characteristic of the first item and the second item that is determined to be the same. Moreover, the first item and the second item may optionally only share a single aspect, but as another option may share a plurality of aspects.

Still yet, the information comparing the first item and a second item may include any type of information that provides a comparison between the first item and the second item. In one embodiment, the information comparing the first item and a second item may include a price difference between the first item and the second item. In another embodiment, the information comparing the first item and a second item may include a price of each of the first item and the second item.

In yet another embodiment, the information comparing the first item and a second item may include at least one advantage of the second item with respect to the first item (or of the first item with respect to the second item). In another embodiment, the information comparing the first item and a second item may include at least one disadvantage of the second item with respect to the first item (or of the first item with respect to the second item). As an option, the advantage may include a physical aspect of the second item that is not shared with the first item and/or the disadvantage may include a physical aspect of the first item that is not shared with the second item (or vice versa).

Just by way of example, the physical aspect may include additional megapixels for a digital camera (e.g. the second item has greater megapixels than the first item or vice versa), additional memory for a mobile device (e.g. the second item has a larger amount of memory than the first item, the second item has a memory card slot for receiving additional memory while the first item does not have a memory card slot, etc. or vice versa), a full keyboard, a digital audio player and/or frequency modulation (FM) radio, etc. Of course, in other embodiments, the advantage and/or disadvantage may be associated with any aspect of the first item and/or second item.

Further, the information comparing the first item and the second item may be displayed in any desired manner that is responsive to the receipt of the first item. In one embodiment, the information comparing the first item and the second item may be automatically retrieved from a database in response to the receipt of the first item. For example, the comparison of the first item and the second item may have been performed prior to the receipt of the first item and the results thereof (i.e. the information comparing the first item and the second item) may optionally therefore have been stored in the database prior to the receipt of the first item. In this way, the information comparing the first item and the second item may be retrieved and displayed automatically in response to the receipt of the first item (e.g. without delay due to performing the comparison as a result of the receipt of the first item, etc.).

In another embodiment, the information comparing the first item and the second item may be displayed with or separately from the information associated with the first item. For example, information associated with the first item and the information comparing the first item and the second item may be displayed via a single GUI. As noted above, the GUI may be associated with a retailer of the first item (e.g. a retailer website), a search engine (e.g. a search engine website), etc. As another example, the information comparing the first item and the second item may be displayed in a same pane of a GUI in which the information associated with the first item is displayed, or in a separate pane of a GUI in which the information associated with the first item is displayed (e.g. as a tooltip, etc.).

To this end, a user from which the first item is received (e.g. that selected the first item for viewing, purchase, etc.) may optionally be automatically provided with information comparing the first item with at least one second item. Accordingly, the user may be provided with comparison information targeted to the first item, such that the user may determine whether the second item is a valuable alternative to the first item. Such targeted comparison information may be utilized for guided selling and/or guided buying.

More illustrative information will now be set forth regarding various optional architectures and uses in which the foregoing method may or may not be implemented, per the desires of the user. It should be strongly noted that the following information is set forth for illustrative purposes and should not be construed as limiting in any manner. Any of the following features may be optionally incorporated with or without the exclusion of other features described.

Figure 4:
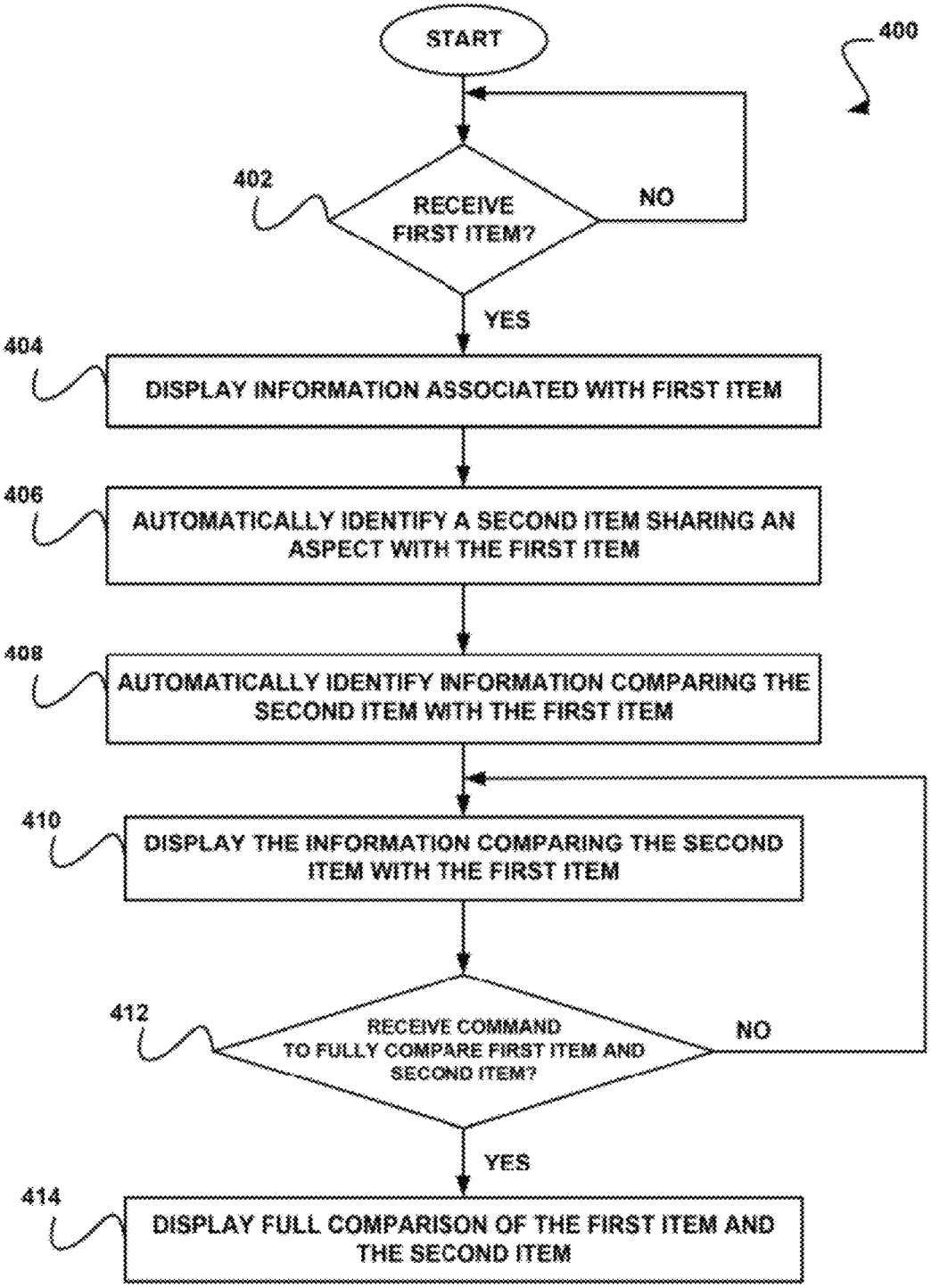
FIG. 4 illustrates a method for automatically displaying information comparing items in response to receipt of the first item, in accordance with another embodiment.

FIG. 4 illustrates a method 400 for automatically displaying information comparing items in response to receipt of the first item, in accordance with another embodiment. As an option, the method 400 may be carried out in the context of the details of FIGS. 1-3. Of course, however, the method 400 may be carried out in any desired environment. Further, the aforementioned definitions may equally apply to the description below.

As shown in decision 402, it is determined whether a first item is received. In one embodiment, the first item may be received as a result of a user selecting the first item (e.g. via a webpage, etc.). In one embodiment, the first item may be received as a result of a user performing a search for the first item (e.g. via a webpage, etc.).

If it is determined that the first item is not received, them method 400 continues to wait for the first item to be received. If, however, it is determined that the first item is received, information associated with the first item is displayed. Note operation 404. The information associated with the first item may be retrieved from a database. For example, the database may store information associated with each of a plurality of items capable of being received. As an option, the information associated with the first item may include a description of the first item, an image of the first item, a price of the first item, etc.

Additionally, a second item sharing an aspect with the first item is automatically identified, as shown in operation 406. In one embodiment, the second item may be identified from a database of items (e.g. goods and/or services). In another embodiment, the second item may be identified based on a determination that the second item shares the most aspects with the first item than any other second item capable of being identified.

In yet another embodiment, the second item may be identified based on a determination that the second item shares a predetermined aspect (e.g. default aspect) with the first item. As another example, the second item may be predetermined with respect to the first item (e.g. stored in the database in association with the first item, pointed to by information stored in the database in association with the first item, etc.).

Further, as shown in operation 408, information comparing the second item with the first item is automatically identified. As an option, the information comparing the second item with the first item may be automatically identified by retrieving such information from the database. For example, the information comparing the second item with the first item may be stored in the database in association with at least one of the first item and the second item.

Still yet, the information comparing the second item with the first item is displayed, as shown in operation 410. With respect to the present embodiment, the information comparing the second item with the first item may include a summary of a comparison between the second item and the first item. For example, the information comparing the second item with the first item may include information regarding a comparison of only a portion (e.g. a subpart) of all aspect of the second item and the first item. Such portion may be predetermined in any desired manner, such as based on predetermined aspects of the first item and/or second item, etc.

In one embodiment, the information comparing the second item with the first item may be displayed in a same pane of a GUI in which the information associated with the first item is displayed. In another embodiment, the information comparing the second item with the first item may be displayed in a different pane of a GUI in which the information associated with the first item is displayed, in a different GUI in which the information associated with the first item is displayed (e.g. in a pop-up), etc.

Moreover, as shown in decision 412, it is determined whether a command to fully compare the first item and the second item is received. The full comparison may provide information comparing all aspects of the first item with the second item. In one embodiment, the command may be received upon a user selecting an option for the full comparison. Such option may include a link provided on the GUI via which the information comparing the second item with the first item is displayed, for example.

If it is determined that the command to fully compare the first item and the second item is not received, the method 400 continues to display the information comparing the second item with the first item (operation 410). If, however, it is determined that the command to fully compare the first item and the second item is received, the full comparison of the first item and the second item is displayed. Note operation 414. In one embodiment, the full comparison may be displayed in the GUI via which the information associated with the first item is displayed. In another embodiment, the full comparison ma be displayed via a GUI separate from the GUI via which the information associated with the first item is displayed (e.g. a pop-up).

In one exemplary embodiment, an agent (e.g. computer code module) of a retail store (e.g. an online retail store) may identify a particular mobile phone requested to be viewed by a customer and may display details of the mobile phone upon identification thereof. Additionally, in response to the identification of the mobile phone, the agent may automatically display alternative products to the customer that each share at least one aspect with the mobile phone. In this way, the agent, in less than a second, may retrieve the key differences between the mobile phone and the alternative products which have already been compared prior to the identification of the mobile pone and may present the key differences to the customer.

Figure 5:
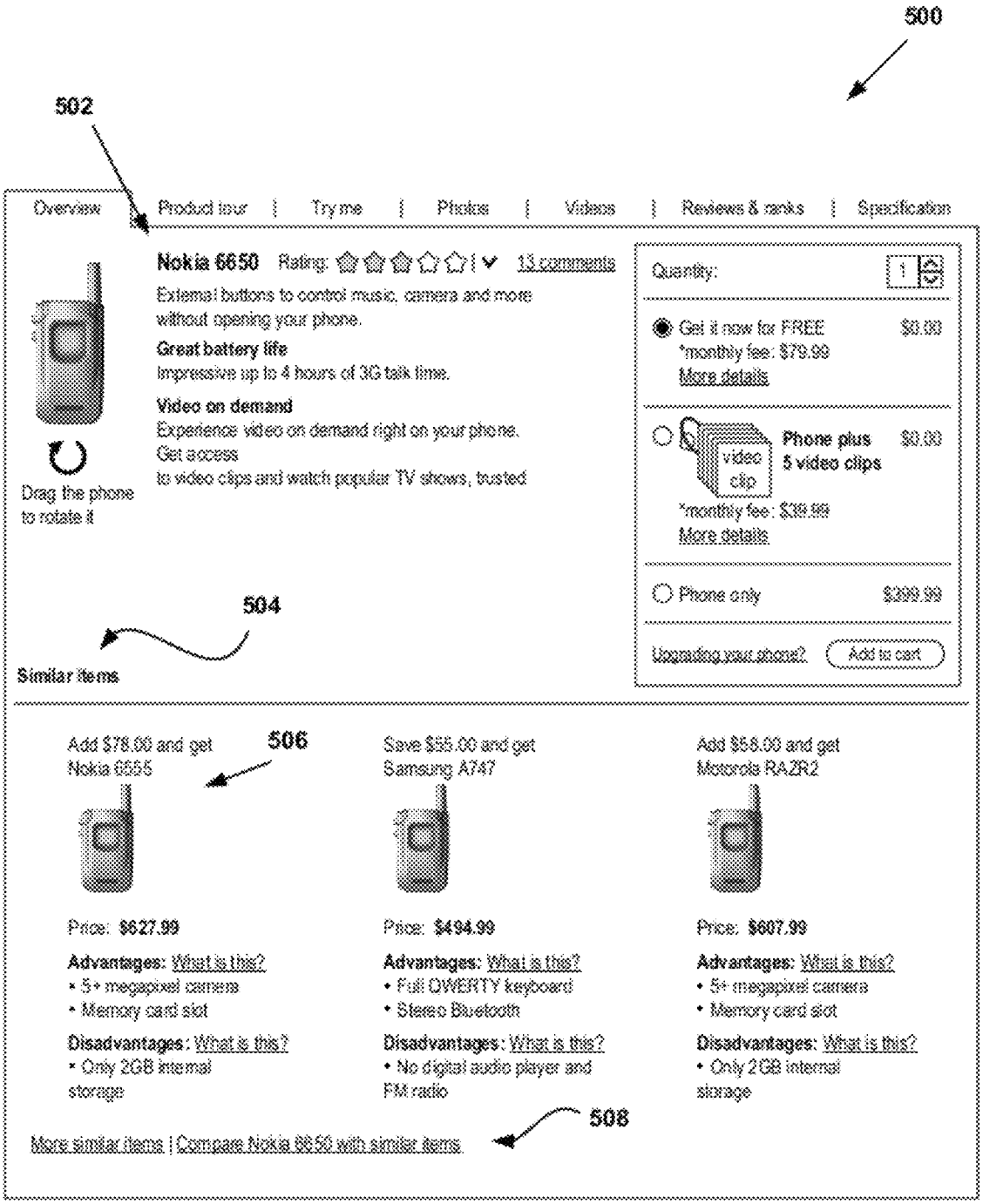
FIG. 5 illustrates a graphical user interface (GUI) for automatically displaying information comparing items, in accordance with yet another embodiment.

FIG. 5 illustrates a GUI 500 for automatically displaying information comparing items, in accordance with yet another embodiment. As an option, the GUI 500 may be implemented in the context of the details of FIGS. 1-3. Of course, however, the GUI 500 may be implemented in any desired environment. Again, the aforementioned definitions may equally apply to the description below.

As shown, the GUI 500 includes a pane for displaying information associated with a first item 502. The first item may include an item selected to be viewed by a user, searched for by the user, etc. Additionally, the information associated with a first item 502 may include a description of the first item, an image of the first item, a price of the first item, a link to other pricing options (e.g. payment plans, etc.) associated with the first item, etc.

The pane may also include a tab or section 504 for comparing the first item with other items. With respect to the present embodiment, the other items include any items that each share at least one aspect with the first item. As an option, upon selection of the tab 504, information comparing the first item with each of the other items 506 may automatically be displayed.

In one embodiment, the information comparing the first item with each of the other items 506 may include a short message in natural language that provides a price difference between the first item and the other item. The first item may optionally be cheaper or more expensive. In other embodiments, information associated with the other item, such as a name of the other item, an image of the other item, a price of the other item, etc., may also be displayed in association with the information comparing the first item with each of the other items 506.

In yet another embodiment, a link 508 to a full comparison (e.g. a "Compare" link, etc.) between the first item and the other item is provided. Upon selection of the link 508 by a user, a full comparison of the first item and the other item is displayed. For example, a pop-up comparing all aspects of the first item and the other item may be displayed. In this way, the major differences may first be shown between the item (e.g. a product, etc.) in context and the other items. A user may then decide immediately whether to reconsider to switch to that similar item or not for further comparison.

In a further embodiment, the information comparing the first item with each of the other items 506 may include advantages and disadvantages of the other item with respect to the first item. Thus, at least some of the information comparing the first item with each of the other items 506 may optionally be grouped based on the advantages and disadvantages. The advantages and disadvantages displayed via the pane may summarize the major differences between the first item and the other item.

Moreover, as an option, icons and/or colors may be utilized to present a type of difference between the first item and the second item provided via the information comparing the first item with each of the other items 506. Just by way of example, the color green and a plus sign may be utilized for presenting the advantages, whereas red and a minus sign may be utilized for presenting the disadvantages.

While various embodiments have been described above, it should be understood that they have been presented by way of example only, and not limitation. Thus, the breadth and scope of a preferred embodiment should not be' limited by any of the above-described exemplary embodiments, but should be defined only in accordance with the following claims and their equivalents.

What is claimed is:

1. A non-transitory computer readable medium encoded with a computer program executable by a processor, comprising:

computer code for receiving a first item for displaying information associated with the first item; and computer code for automatically displaying information comparing the first item and a second item in response to the receipt of the first item, the second item sharing at least one aspect with the first item, where the second item is selected for display based on the determination that the second item shares the at least one aspect with the first item;

wherein the information comparing the first item and the second item includes a price difference between the first item and the second item;

wherein the computer program is operable such that the second item is selected for displaying the information comparing the first item and the second item based on a determination that the second item shares a greatest number of aspects with the first item than any other second item capable of being selected;

wherein the information comparing the first item and the second item includes information regarding a comparison of only a portion of all aspects of the second item and the first item, and the computer program is operable such that a full comparison providing information comparing all aspects of the first item with the second item is displayed upon receipt of a command from a user for the full comparison, the command including the selection of a link, where the full comparison is displayed via a first graphical user interface (GUI) separate from a second GUI via which the information associated with the first item is displayed;

wherein the computer program is operable such that the comparison of only the portion of all aspects of the first item and the second item is performed prior to the receipt of the first item and the information comparing the first item and the second item is stored in a database prior to the receipt of the first item, such that the information comparing the first item and the second item is retrieved and displayed automatically in response to the receipt of the first item without delay otherwise caused due to performing the comparison as a result of the receipt of the first item.

2. The computer program of claim 1, wherein the first item includes one of a good and a service.

3. The computer program of claim 1, wherein the information associated with the first item includes a description of the first item.

4. The computer program of claim 1, wherein the information associated with the first item includes a price of the first item.

5. The computer program of claim 1, wherein the information associated with the first item includes an image of the first item.

6. The computer program of claim 1, wherein the information associated with the first item includes a link to supplemental information associated with the first item.

7. The computer program of claim 1, wherein the at least one aspect shared by the second item and the first item includes a category.

8. The computer program of claim 1, wherein the at least one aspect shared by the second item and the first item includes a manufacturer.

9. The computer program of claim 1, wherein the at least one aspect shared by the second item and the first item includes a color.

10. The computer program of claim 1, wherein the at least one aspect shared by the second item and the first item includes a default aspect.

11. The computer program of claim 1, wherein the at least one aspect shared by the second item and the first item is updatable by a user.

12. The computer program of claim 11, wherein the information comparing the first item and the second item is automatically updated in response to the user updating the at least one aspect shared by the second item and the first item.

13. The computer program of claim 1, wherein the information comparing the first item and the second item includes at least one advantage of the second item with respect to the first item.

14. The computer program of claim 1, wherein the information comparing the first item and the second item includes at least one disadvantage of the second item with respect to the first item.

15. The computer program of claim 1, further comprising computer code for automatically retrieving the information comparing the first item and the second item from a database in response to the receipt of the first item.

16. The computer program of claim 1, wherein the information associated with the first item and the information comparing the first item and the second item are displayed via a single graphical user interface.

17. The computer program of claim 1, wherein the first GUI includes a pop-up.

18. A computer-implemented method, comprising:

receiving a first item for displaying information associated with the first item; and automatically displaying information comparing the first item and a second item in response to the receipt of the first item, utilizing a processor, the second item sharing at least one aspect with the first item, where the second item is selected for display based on the determination that the second item shares the at least one aspect with the first item;

wherein the information comparing the first item and the second item includes a price difference between the first item and the second item;

wherein the second item is selected for displaying the information comparing the first item and the second item based on a determination that the second item shares a greatest number of aspects with the first item than any other second item capable of being selected;

wherein the information comparing the first item and the second item includes information regarding a comparison of only a portion of all aspects of the second item and the first item, and a full comparison providing information comparing all aspects of the first item with the second item is displayed upon receipt of a command from a user for the full comparison, the command including the selection of a link, where the full comparison is displayed via a first graphical user interface (GUI) separate from a second GUI via which the information associated with the first item is displayed;

wherein the comparison of only the portion of all aspects of the first item and the second item is performed prior to the receipt of the first item and the information comparing the first item and the second item is stored in a database prior to the receipt of the first item, such that the information comparing the first item and the second item is retrieved and displayed automatically in response to the receipt of the first item without delay otherwise caused due to performing the comparison as a result of the receipt of the first item.

19. A system, comprising:

a processor and a module for receiving a first item for displaying information associated with the first item, and automatically displaying information comparing the first item and a second item in response to the receipt of the first item, the second item sharing at least one aspect with the first item, where the second item is selected for display based on the determination that the second item shares the at least one aspect with the first item;

wherein the information comparing the first item and the second item includes a price difference between the first item and the second item;

wherein the second item is selected for displaying the information comparing the first item and the second item based on a determination that the second item shares a greatest number of aspects with the first item than any other second item capable of being selected;

wherein the information comparing the first item and the second item includes information regarding a comparison of only a portion of all aspects of the second item and the first item, and the system is operable such that a full comparison providing information comparing all aspects of the first item with the second item is displayed upon receipt of a command from a user for the full comparison, the command including the selection of a link, where the full comparison is displayed via a first graphical user interface (GUI) separate from a second GUI via which the information associated with the first item is displayed;

wherein the comparison of only the portion of all aspects the first item and the second item is performed prior to the receipt of the first item and the information comparing the first item and the second item is stored in a database prior to the receipt of the first item, such that the information comparing the first item and the second item is retrieved and displayed automatically in response to the receipt of the first item without delay otherwise caused due to performing the comparison as a result of the receipt of the first item.

20. The system of claim 19, wherein the processor is coupled to memory via a bus.

* * * * *